US005248372A

United States Patent [19]

McNamee

[11] Patent Number: 5,248,372

[45] Date of Patent: Sep. 28, 1993

[54] APPARATUS FOR PICKLING A METAL SHEET MATERIAL

[75] Inventor: Donald C. McNamee, Willoughby, Ohio

[73] Assignee: Production Machinery Corporation, Mentor, Ohio

[21] Appl. No.: 941,954

[22] Filed: Sep. 8, 1992

[51] Int. Cl.[5] ..... B44C 1/22; C23F 1/00

[52] U.S. Cl. ..... 156/345; 156/644; 134/122 R; 204/194

[58] Field of Search ..... 156/664, 345; 134/15, 134/26, 28, 41, 64 R, 105, 122 R; 204/129.1, 129.35, 141.5, 194

[56] References Cited

U.S. PATENT DOCUMENTS 3,066,084 11/1962 Osterman et al. ..... 134/15 X
4,920,995 5/1990 Seiz et al. ..... 134/15
5,116,447 5/1992 Kimura et al. ..... 134/44 X

FOREIGN PATENT DOCUMENTS 0693703 9/1964 Canada ..... 134/15

*Primary Examiner*—William A. Powell
*Attorney, Agent, or Firm*—Body, Vickers & Daniels

[57] ABSTRACT

Apparatus for pickling metal sheet as it moves along a generally flat horizontal path, comprises elongated shallow and sequentially arranged electrolytic pickling and mixed acid pickling tanks each having input and output ends and through which metal sheet to be pickled is continuously fed along a linear, flat path through the use of support rolls underlying the metal sheet at spaced locations between the input and output ends of the tanks. Pickling liquid is maintained in each of the tanks at a given level above the support rolls, whereby the sheet material is immersed in the pickling liquid between the input and output ends of the corresponding tank. Each tank has guide rolls at the input and output ends thereof for guiding the sheet material therethrough, and the support rolls are driven at the speed of the sheet material to minimize the tension on the sheet as it is being pickled. Seal arrangements are provided for sealing the rolls relative to the tanks where the sealing means includes two axially spaced rings with extending lips on each end of the driven rolls and two low friction plates mounted on the tank and engageable by a lip of a sealing ring as the two rings rotate with a roll. Arrangements are provided for recirculating the pickling liquid, and a displaceable cover arrangement is provided for the pickling tanks.

32 Claims, 9 Drawing Sheets

APPARATUS FOR PICKLING A METAL SHEET MATERIAL

BACKGROUND OF THE INVENTION

The present invention relates to the art of pickling metal sheet material and, more particularly, to improved apparatus for pickling a continuous length of metal sheet or metal plates.

It is appreciated that the present invention can be used for pickling, cleaning, etc. of various metals as the metal is moved along a generally horizontal process path; however, the invention is particularly applicable to pickling a continuous strip of stainless steel by acid and will be described with respect thereto. This description is representative in nature. The invention can be used for discrete plates of metal passing along a generally horizontal path. Some aspects of the invention can be used for sealing a support, dam and/or drive roll of a chemical tank.

It is of course well known to pickle metal sheet such as stainless steel, for the purpose of removing surface oxide and scale from the metal sheet, by passing the sheet through a grid work of electrodes in an electrolytic pickling tank an/or through an acid pickling tank. Heretofore, apparatus for pickling a continuous length of metal sheet material, such as stainless steel strip, included a relatively deep tank structure in which the metal sheet followed a generally U-shaped path between pairs of rolls at input and output ends of the tank. Frequently, a center roll or rolls at the lower end of the U are necessary in order to hold the strip down in the tank. Such a relatively deep tank structure requires a considerable amount of pickling solution to fill the tank. In connection with the electrolytic pickling of a continuous strip, which is generally used for non-stainless steel strip, the tank includes electrodes through which the metal sheet passes. When it is necessary to drain the pickling solution from the tank, it is necessary to stop the process and movement of the metal sheet through the tank. Further, feeding the metal strip through the tank along a U-shaped path imposes relatively high tension on the strip, especially if center rolls are employed to hold the sheet down in the tank.

All of the foregoing problems affect the cost of the pickling equipment, the cost of the pickling operation using the equipment and/or the quality of pickling of the sheet material or plate being processed.

SUMMARY OF THE INVENTION

In accordance with the present invention, pickling apparatus is provided which minimizes or overcomes the foregoing problems, thus providing for a more economical and efficient pickling operation and improved quality with respect to the end product. More particularly in this respect, electrolytic and/or acid pickling tanks in accordance with the present invention are elongated and relatively shallow and provide for a continuous length of metal sheet or plate to be fed therethrough, immersed in the pickling liquid therein, along a linear, generally flat horizontal path between input and output ends of the tank. The flat path of movement of the metal sheet through the tank enables minimizing the depth of the pickling liquid therein. Movement of the sheet material through the tank along a linear, generally flat horizontal path is achieved in part by providing support rolls beneath the sheet material at spaced locations between the input and output ends of the tank.

In some instances, a support roll could be replaced by a set of transverse, upwardly projecting, jets beneath the moving strip. The pickling liquid impinges upon the under surface of the moving strip to support a segment of the strip in a vertical direction. This support of the sheet material, preferably with rolls, not only promotes minimizing the depth of the tank and, thus, the volume of pickling liquid required to achieve immersion of the sheet material, but also promotes a reduction of the tension build-up in the sheet material required to achieve transport thereof through the tank. Tension build-up occurs when a strip is flexed between rolls to create losses due to plastic deformation of the metal strip. Pairs of dam rolls are provided at the input and output ends of the tank for the purpose of retaining liquid in the generally flat tank and, preferably, the support rolls beneath the sheet material are driven at the speed of movement of the sheet material through the tank. This promotes movement of the strip through the pickling tank without the sheet material being scored or marked.

In accordance with a primary aspect of the present invention a novel seal arrangement is provided between the side walls of the tank and the dam rolls and support rolls to minimize leakage of pickling liquid from the tank while permitting relative displacement between the roll shafts and tank walls transverse to the roll axes to accommodate thermal expansion and contraction of the tank during operation. Preferably, to optimize the sealing capability, each of the opposite ends of the dam and support rolls has a double sealing arrangement comprising a pair of axially spaced sealing members engaging spaced side wall portions of the tank. Preferably, a trough is provided between the pair of seals for collecting pickling liquid which may leak from the tank and returning the liquid to a reservoir or the like. The pickling liquid is maintained at a predetermined level in the tank by structurally simple weir-like overflow arrangements at opposite ends of the tank, and the low volume of pickling liquid required as a result of the flat, horizontal feed path and shallowness of the tank makes it possible to recirculate the pickling liquid relative to the tank, thus to optimize maintaining a desired temperature for the liquid as well as purity thereof. Such control of the temperature of the pickling liquid provides for considerable improvement in the quality of the end product. The recirculation of the pickling solution also increases the flow of the solution along and over the surfaces of the moving metal to increase the effectiveness of the pickling process. Moreover, when it is necessary to drain the pickling tank, the low volume of pickling liquid promotes rapid draining of the tank and the subsequent refilling thereof.

In accordance with another aspect of the invention, the top of the pickling tank can be closed by a plurality of covers which are displaceable laterally of the tank between covering and uncovering relationship relative thereto. This advantageously enables covering of the tank between the input and output ends in discrete selective sections. This encourages use of the covers or lids. An exhaust system for fumes from the tank can be easily accommodated. Covering the tank in this manner enables minimizing the size of the system required to exhaust fumes from the tank during operation of the pickling line. Also, a simple mechanical arrangement can move the individual covers from a position resting on the top of the tank to a retracted opened position.

It is accordingly an outstanding object of the present invention to provide improved apparatus for pickling or cleaning of a material moving in a flat, horizontal path, such as a continuous length of metal sheet, flat plates, or the like.

Another object is the provision of apparatus of the foregoing character wherein metal sheet to be pickled is fed through a shallow pickling tank, immersed in pickling liquid therein, and along a linear, substantially flat horizontal path between input and output ends of the tank.

A further object is the provision of pickling apparatus of the foregoing character which minimizes the volume of pickling liquid required in the tank, promotes movement of the strip through the tank without damage, and facilitates processing of the pickling liquid, all to provide improved quality with respect to the pickled end product.

Still another object of the invention is the provision of apparatus of the foregoing character wherein the metal sheet is supported between the input and output ends of the tank on underlying support rolls which are driven at the speed of movement of the sheet through the tank.

Another object of the present invention is the provision of a novel sealing arrangement for the ends of rolls in a pickling tank, which sealing arrangement is useable in a variety of continuous industrial processes for treating metal by a liquid in a tank, such as a pickling tank.

Another object of the invention is the provision of a novel sealing arrangement at each end of a driven roll in a liquid chemical tank, which sealing arrangement includes two axially spaced, radially extending sealing rings with protruding annular lips rotatable against low friction plates fixed in spaced positions at each end of the driven roll.

Still a further object is the provision of apparatus of the foregoing character wherein the pickling liquid is recirculated relative to the tank to maintain a desired temperature of the pickling liquid and to improve the effectiveness of the process.

Still another object is the provision of apparatus of the foregoing character wherein the pickling tank has a removable cover arrangement which promotes a reduction in the size of the exhaust system required to exhaust fumes from the tank and using segments which can be easily removed and retracted.

Still a further object of the invention is the provision of apparatus of the foregoing character wherein dam and support rolls for the metal sheet material are immersed in the pickling liquid and supported relative to the pickling tank in a manner which minimizes the leakage of pickling liquid therefrom.

Another object is the provision of apparatus of the foregoing character which is structurally simple and efficient in operation and which promotes providing improved quality of the pickled product while optimizing maintenance and consumption of the pickling liquid, thus to promote economy with respect to operation of a pickling line.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
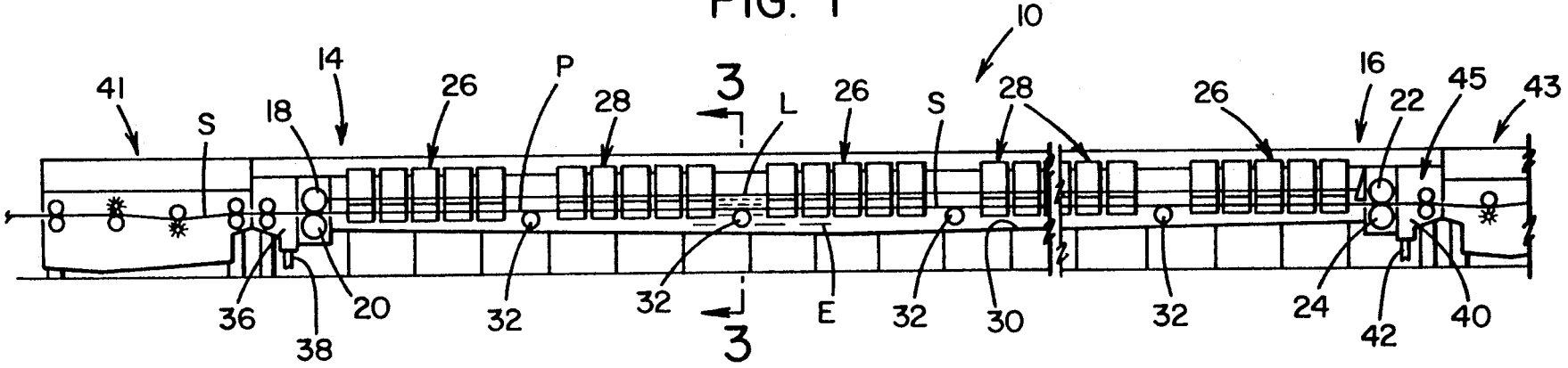
FIG. 1 is a schematic elevational view of an electrolytic pickling tank in accordance with the present invention.
Figure 2:
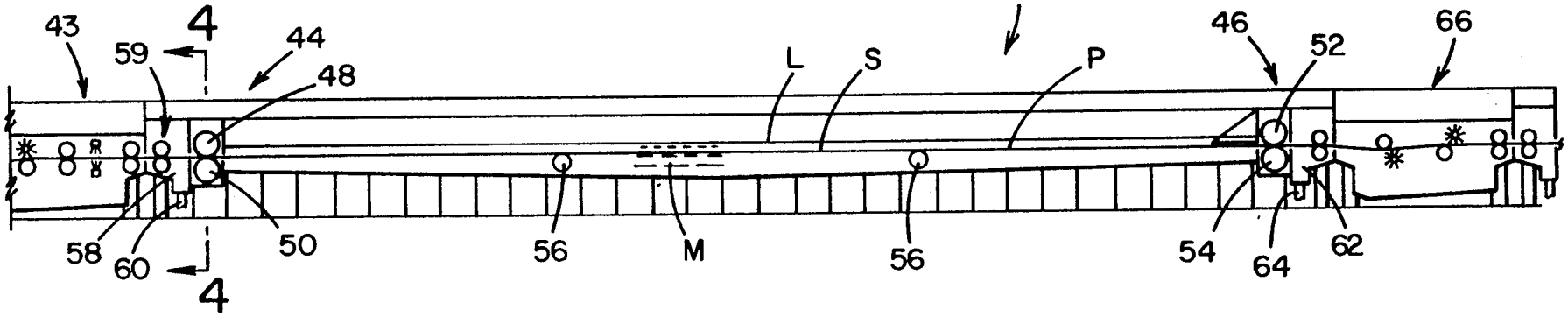
FIG. 2 is a schematic elevational view of an acid pickling tank in accordance with the present invention.

Referring now in greater detail to the drawings wherein the showings are for the purpose of illustrating preferred embodiments of the invention only, and not for the purpose of limiting the invention, FIG. 1 illustrates an electrolytic pickling tank 10 and FIG. 2 illustrates an acid pickling tank 12. Each of the tanks 10 and 12 could be independently operated in connection with performing the corresponding type of pickling on a metal sheet fed therethrough but, in the embodiment disclosed, tank 12 follows tank 10 to provide a pickling line in which a continuous sheet of metal, such as stainless steel, is sequentially subjected to electrolytic and acid pickling. As will become apparent hereinafter, pickling tanks 10 and 12 have a number of structural features in common.

Basically, electrolytic pickling tank 10 includes an input end 14 and an output end 16, driven upper and lower dam rolls 18 and 20, respectively, at input end 14 and driven upper and lower dam rolls 22 and 24, respectively, at output end 16. Two cathode grids 26 and intermediate anode grids 28 are arranged, in sets, between ends 14 and 16. A continuous sheet of metal S is fed through tank 10 from input end 14 to output end 16 between the pairs of dam rolls. Tank 10 has a bottom 30 and is filled with a suitable electrolyte E to a predetermined level L which provides for metal sheet S to be immersed in the electrolyte as it moves from input end 14 to output end 16. A bridle at each end of the process line feeds the strip S through the tanks. Since the strip moves in a flat horizontal path P, the outlet bridle pulls the strip with a minimum force. There is no substantial tension build-up. Consequently, the power to transport strip S is minimized as is marking of the strip. In accordance with the present invention, sheet S is supported to move along a linear, substantially flat horizontal path between input end 14 and output end 16 by a plurality of support rolls 32 spaced apart between the input and output ends and underlying sheet S. Rolls 18, 20, 22, 24 and 32 are rotatably supported relative to tank 10 as described hereinafter. Dam rolls 18 and 20 and 22 and 24 are independently driven at a predetermined speed and, preferably, support rolls 32 are independently driven at a speed corresponding to the speed of sheet S. This feed and support arrangement for sheet S advantageously reduces the size of the feed bridles necessary to move the sheet through the tank and also the pinching forces on the metal sheet, thus to promote a reduction in the cost of the equipment and minimizing of the tension build-up on the sheet, as well as marking of the sheet by the rolls. Marking which might occur if the underlying support rolls were not driven. The dam and support arrangement also promotes minimizing the required depth and thus volume of pickling liquid required to maintain sheet S immersed therein during its movement through the tank.

As will be described in greater detail hereinafter in accordance with the invention, the axially opposite ends of feed rolls 18, 20, 22 and 24 and the axially opposite ends of support rolls 32 are each sealed relative to the corresponding side wall of tank 10 against leakage of the electrolyte from the tank, and the input and output ends of the tank are provided with weir-like overflow arrangements for maintaining the electrolyte E at predetermined level L in the tank. At input end 14, sump 36 is provided for electrolyte leaking past feed rolls 18 and 20, and sump 36 is connected to a drain 38 for returning the electrolyte to a reservoir therefor. Similarly, a sump 40 is provided at output end 16 of the tank for electrolyte leaking past dam rolls 22 and 24, and sump 40 is connected to a drain 42 for the same purpose as drain 38. Squeegee rolls 45 in sump 40 remove pickling liquid from sheet S as the latter moves through the sump area.

Acid pickling tank 12 is structurally similar to electrolytic pickling tank 10 and, in this respect, has an input end 44 and an output end 46 between which metal sheet S is fed by a standard set of bridles through the tank through upper and lower dam rolls 48 and 50, respectively, at input end 44 and upper and lower dam rolls 52 and 54, respectively, at output end 46. Metal sheet S is fed through tank 12 along a linear, generally flat path slightly immersed in acid pickling liquid M, and sheet S is supported for displacement in this respect by driven support rolls 56 which are spaced apart between the input and output ends of the tank and underlie metal sheet S. Preferably, for the same purpose set forth hereinabove with respect to support rolls 32 in tank 10, support rolls 56 are driven at the speed of movement of sheet S through tank 12. Further, as will become apparent hereinafter, rolls 48, 50, 52 and 54 and support rolls 56 are rotatably supported and driven and are sealed relative to the side walls of tank 12 in the same manner as the corresponding rolls in tank 10. The novel system for sealing the rolls with respect to the sides of the chemical tanks is a primary aspect of the present invention and is shown in detail in FIGS. 3–5. This arrangement includes two spaced sealing rings engageable with low friction plates. This is especially applicable for driven rolls of a chemical processing tank where the driving devices may wobble and where the rolls are to move both axially and radially while the tank shifts in all directions with respect to the drive train. Still further, tank 12 is provided with weir-like overflow arrangements at the input and output ends thereof for maintaining the acid pickling liquid M at predetermined level L in the tank, which level is just above path P.

As will be appreciated from FIG. 1, sheet S passes through a preliminary cleaning zone 41 which precedes input end 14 of the tank and passes through a brushing and rinsing zone 43 which follows output end 16 of the tank and thus precedes entrance of the sheet into mixed acid pickling tank 12. Dam rolls 48 and 50 at input end 44 of tank 12 are associated with a sump 58 having a drain 60 for returning the acid to a reservoir therefor, and squeegee rolls 59 in the sump area remove cleaning liquid from sheet S as it emerges from rinsing zone 43. Dam rolls 52 and 54 at output end 46 of the tank are associated with a sump 62 having a drain 64 for the same purpose as drain 60. Sheet S exits through output end 46 of pickling tank 12 and then passes through a brushing zone 66 and thence to a collecting station or further processing equipment, not shown.

As a unique feature of the invention, strip S passes in a generally flat horizontal path P and a shallow body of liquid is controlled to cover the top surface of the moving strip. The spaced bridles keep the strip moving in a straight line to reduce flexing and, thus, energy loss. It is possible to use transversely spaced jets to support certain sections of the strip. This would further enhance the surface contact effectiveness of the liquid. Recirculation of the bath solution also accomplishes the objective.

Figure 3:
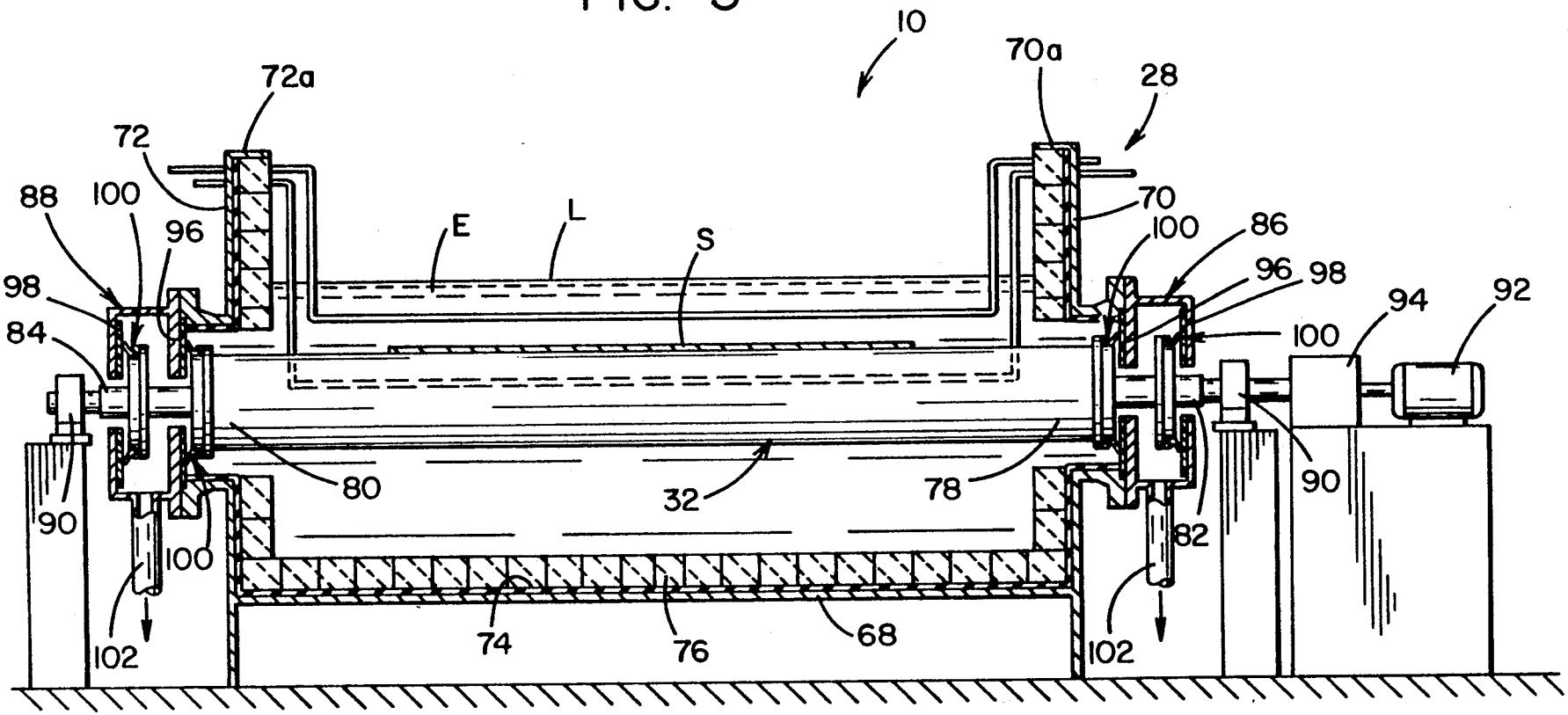
FIG. 3 is a cross-sectional elevation view of the electrolytic tank taken along line 3—3 in FIG. 1.

Referring now to FIG. 3 of the drawing, electrolytic pickling tank 10 includes a bottom wall 68 and laterally spaced apart side walls 70 and 72. The tank could be formed of a plastic which is not affected by the liquid in the tank or the interior of the tank could be lined in a well known manner with rubber 74 and brick 76, as shown. Any well known tank construction could be employed. As will be appreciated from FIG. 3, each of the support rolls 32 underlying sheet S has axially opposite ends 78 and 80 extending into flanged openings therefor in the corresponding side wall of the tank, and support shafts 82 and 84 extending outwardly from ends 78 and 80, respectively, through enlarged openings therefor in housings 86 and 88 secured to the outer ends of the flanged openings in side walls 70 and 72, respectively. Shafts 82 and 84 are mounted in suitable bearings or trunions 90 to support roll 32 for rotation, and shaft 82 extends through the corresponding bearing and is connected to a drive motor 92 through a gear box 94 therebetween, which drive motor and gear box are operable to drive support roll 32 at the speed of sheet S as described hereinabove. The sealing arrangement is a novel feature of the pickling tank.

Each of the housings 86 and 88 includes a corresponding inner wall provided with a seal plate 96 and a corresponding outer wall provided with a seal plate 100 spaced axially outwardly from plate 96. Ends 78 and 80 of support roll 32 are sealed relative to the corresponding side wall of the tank and, preferably, by a double seal arrangement which seals the support roll and shafts 82 and 84 relative to the corresponding seal plates 96 and 98 of housings 86 and 88. More particularly in this respect, outer ends 78 and 80 of support roll 32 are provided with annular sealing members 100, the structure of which is described in greater detail hereinafter. Sealing members 100 are mounted on support roll 32 for rotation therewith and slidably and sealably engage the inner side of the corresponding seal plate 96 of housings 86 and 88. Similarly, the portions of shafts 82 and 84 between seal plates 96 and 98 of the corresponding housing are provided with annular sealing members 100 which are rotatable therewith and which slidably and sealably engage the inner side of the corresponding outer seal plate 98. The seals are commercial products; however, the use of separate plates 96 and 98 allows optimized use of the seals so they can be used in pickling lines. Indeed, the pickling lines present unique sealing problems as to changes during actual use and the need to shift at least the top roll vertically during threading. The bottom support rolls also move vertically during use. The plates are formed from cast Teflon of the type known as Super PTFE sold by Enflo Corporation.

The openings through separate, low friction seal plates 96 and 98 for shafts 82 and 84 are larger than the shafts. Relative displacement can take place between the tank and the roll and its shaft, both axially and transverse to the shaft axis, during use of the tank, without interference between the roll, roll shaft and tank walls. Such displacement may result, for example, from thermal expansion and contraction of the tank and/or rolls during a pickling operation. The shafts can also flex by weight of the strip and tension forces on the strip. Annular seals 100 engage the corresponding seal plate radially outwardly of the opening therethrough and, as will become apparent hereinafter, in a manner which accommodates both axial and lateral displacement between the rolls, shafts and housings 86 and 88 without affecting the integrity of the sealed relationship therebetween. Each of the housings 86 and 88 provides a sump having a corresponding drain line 102 connected to a reservoir for the electrolyte, whereby any electrolyte leaking across the inner seal is returned to the reservoir for recirculation relative to the tank as explained more fully hereinafter. The foregoing support and sealing arrangement for support rolls 32 is applicable to support roll 56 in acid pickling tank 12.

Figure 4:
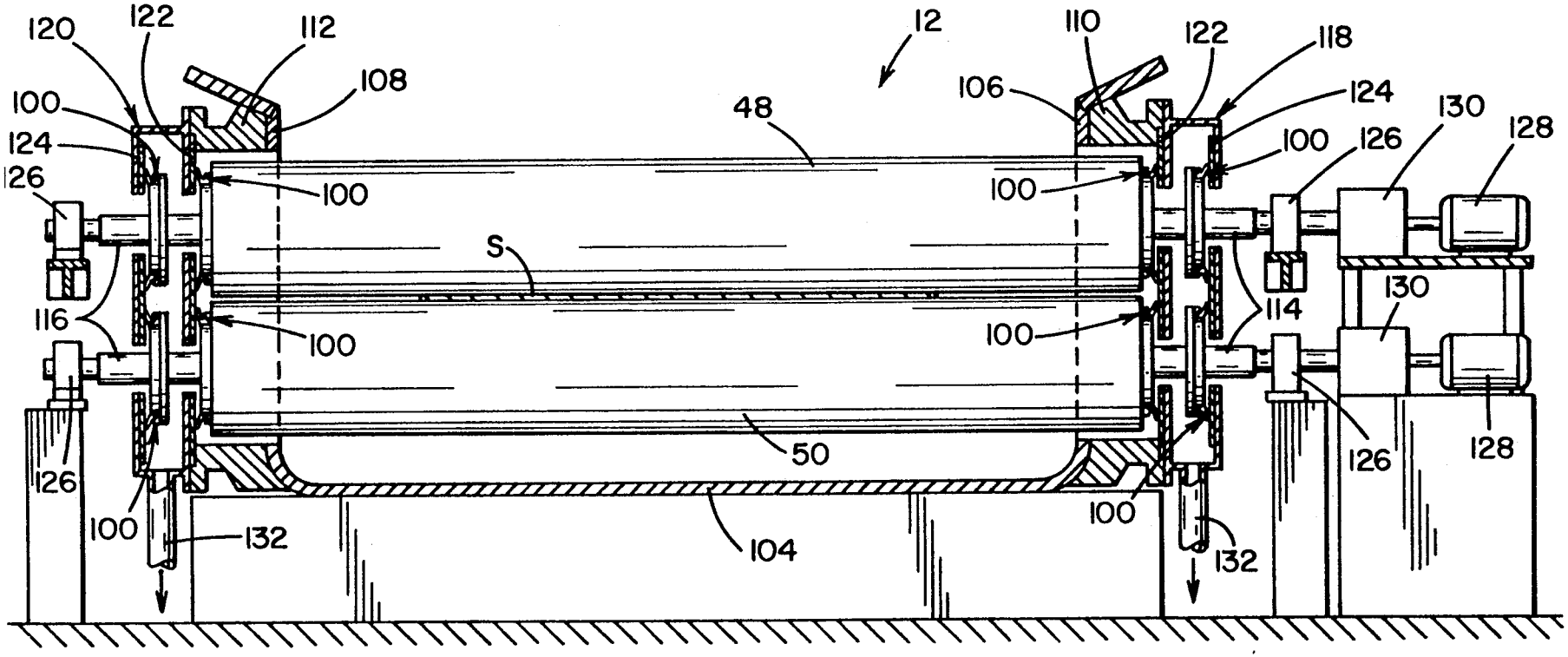
FIG. 4 is a cross-sectional elevation view of the acid tank taken along line 4—4 in FIG. 2.

Referring now to FIG. 4, acid pickling tank 12 includes a bottom wall 104 and laterally spaced apart sides 106 and 108. In this embodiment, these sides or walls are formed from suitable plastic material; however, other materials can be used. Dam rolls 48 and 50 at the input end of tank 12 have axially opposite ends extending through openings therefor in side walls 106 and 108 and corresponding support members 110 and 112 secured to the outer surfaces of side walls 106 and 108, respectively. The axially opposite ends of each of the dam rolls 48 and 50 include shafts 114 and 116 extending therefrom through openings therefor in housings 118 and 120 secured to support members 110 and 112 respectively. Each of the housings includes an inner wall provided with a low friction seal plate 122 and an outer wall provided with a low friction seal plate 124 spaced axially outwardly from plate 122. Roll shafts 114 and 116 are rotatably supported by corresponding bearings 126, and each shaft 114 is connected to a corresponding drive motor 128 through a gear box 130. The motor, gear box and bearing are below the top edge of the tank to accommodate sectional lids or covers shown in FIGS. 7 and 7.

As described hereinabove in connection with support roll 32, the axially opposite ends of each of the rolls 48 and 50 are provided with annular sealing members 100 rotatable therewith and sealingly engaging the corresponding inner low friction seal plate 122, and shafts 114 and 116 are provided with annular sealing elements 100 which are rotatable therewith and sealingly engage against the corresponding outer seal plate 124. Any leakage of the acid pickling solution across seals 100 at the opposite ends of dam rolls 48 and 50 enters the corresponding one of the housings 118 and 120 and is returned to the acid reservoir through drain lines 132 at the bottoms of the housings. The foregoing description of the support, drive and sealing of dam rolls 48 and 50 at input end 44 of the acid tank 12 is applicable to the pairs of dam rolls at output end 46 of the latter tank as well as the pairs of feed rolls at input end 14 and output end 16 of electrolytic pickling tank 10.

Figure 4A:
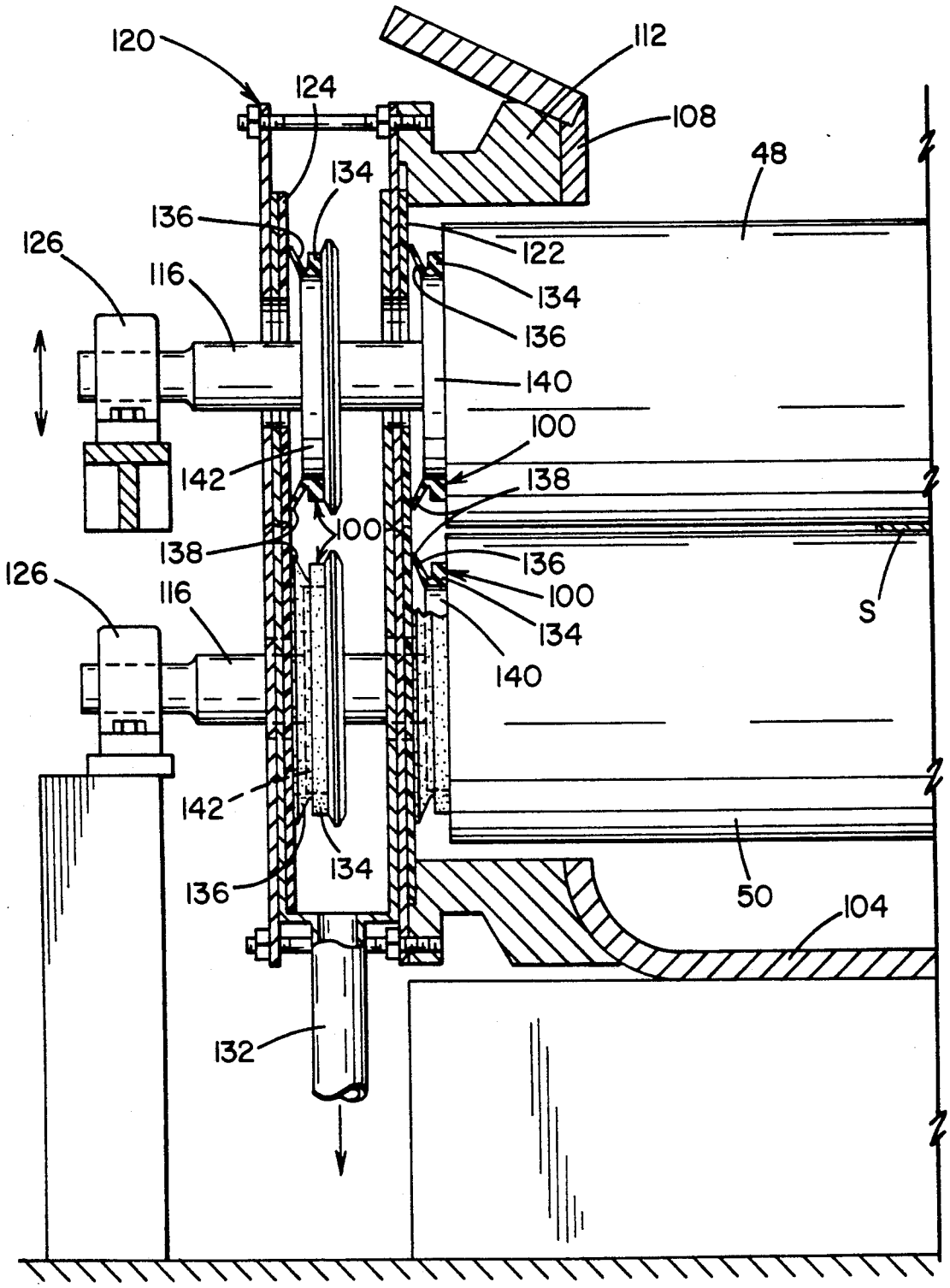
FIG. 4A is an enlarged cross-sectional elevation view showing the sealing arrangement between the dam rolls and side walls of the acid tank.

Annular sealing members 100 are of a suitable sealing material such as rubber and, as best seen in FIG. 4A, each of the sealing members includes an annular body portion 134 which is generally rectangular in cross-section, and a resilient annular sealing lip 136 integral with body 134 at the radially inner periphery thereof. Lip 136 extends from body portion 134 toward the corresponding one of the low friction sealing plates 122 and 124 in diverging relationship relative to the corresponding body portion 134. Each of the sealing lips 136 has a circumferentially continuous outer end 138 slidably and sealingly engaging the corresponding seal plate radially outwardly of the opening therethrough for roll shaft 116. The diverging configuration of lip 136 biases end 138 axially toward the seal plate and thus accommodates relative axial displacement between the end of the roll and the seal plate while maintaining the integrity of the sealed relationship therebetween. The ends of rolls 48 and 50 are provided with mounting collars 140 on which body portion 134 of the corresponding seal member 100 is mounted and which, for this purpose, are of a diameter slightly larger than that of the opening through the body portion. Roll shafts 116 are provided with mounting collars 142 within housing 120 for the corresponding seal member 100 and which collars support the corresponding seal member in the same manner as mounting collars 140. It will be appreciated, of course, that the foregoing description of the sealing members and the supporting arrangements therefor are applicable to the sealing of the support rolls 32 and 56 relative to pickling tanks 10 and 12, respectively, as well as to the feed rolls 18, 20, 22 and 24 in tank 10, and feed rolls 52 and 54 in tank 12. The seals are known; however, use in the combination for double seals with an intermediate sump prevents any inadvertent egress of pickling solution. In addition, use of the low friction plates instead of the tank side wall surface enhances the sealing feature and allows use of the seals on a pickling tank. The low friction plates optimize the sealing interface. By use of the novel sealing arrangement, the rolls can be opened and closed either intentionally or by action of the process. As strip thickness changes, the seal is maintained.

Figure 5:
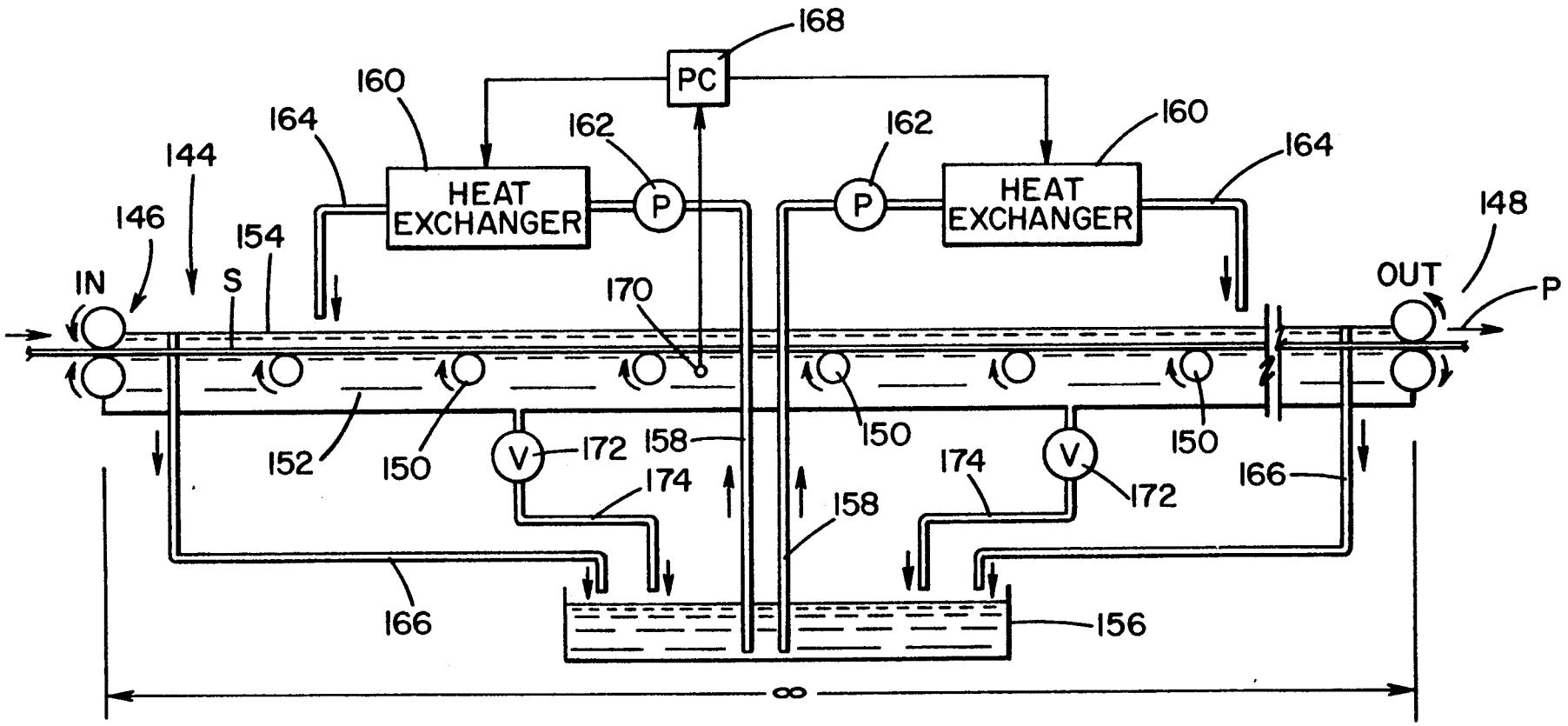
FIG. 5 is a schematic illustration of an arrangement for recirculating and heating pickling liquid in a pickling tank according to the present invention.

The movement of a metal sheet through the pickling tanks along a generally flat path as described hereinabove advantageously enables minimizing the depth of the pickling tank and thus the depth and quantity of pickling liquid required in connection with a pickling operation in such tank. The novel sealing combination prevents leakages while causing a low amount of drag. In accordance with another aspect of the present invention, as schematically illustrated in FIG. 5, these features of the pickling apparatus advantageously facilitate the use of a pickling liquid recirculating system which enables maintaining a desired temperature of the pickling liquid and thus the metal strip being pickled so as to optimize the quality of the pickled sheet. Constant movement of the liquid and the strip creates an effective interaction of the liquid with the strip surface. The effectiveness of the pickling process is enhanced. Moreover, the shallow pickling structure and low volume of pickling liquid enable the tank to be filled rapidly through a heat exchanger which heats the pickling liquid to the desired temperature and, likewise, enables the tank to be rapidly emptied when necessary, thus to minimize maintenance time and down time in connection with these procedures. Such a recirculating system is shown in FIG. 5 in connection with a schematically represented pickling tank 144 shown as having input and output ends 146 and 148, respectively. Each end has a pair of dam rolls, not designated numerically. A metal sheet S is fed through the tank along a linear, generally flat path P. The latter path is defined in part by a plurality of support rolls 150 spaced apart between the input and output ends of the tank and underlying sheet S. Tank 144 contains a pickling liquid 152 having an upper level 154 which provides for sheet S to be immersed as it passes through the tank.

Pickling liquid 152 is recirculated relative to tank 144 from a reservoir 156 by means of a pair of feed lines 158 leading from the reservoir to a corresponding heat exchanger 160 through corresponding pumps 162 in lines 158. Output lines 164 from heat exchangers 160 direct the heated pickling liquid into tank 144, and overflow lines 166 provide for maintaining the liquid at level 154 and for the return of pickling liquid from tank 144 to reservoir 156. Heat exchangers 160 can be provided with any suitable source of heat for heating the pickling liquid passing therethrough and can, for example, be heated by steam or by electrical resistance heaters. A process controller 168 controls the operation of heat exchangers 160 with respect to the heating of pickling liquid passing therethrough and, in connection with such control, process controller 168 is responsive to the temperature of pickling liquid 152 in tank 144 as sensed by a temperature probe 170 immersed in the pickling liquid in the tank. Should it be desired to empty the pickling tank, this is quickly achieved by de-energizing pumps 162 and opening valves 172 in drain lines 174, whereby the pickling liquid flows to reservoir 156 through the latter lines. When it is desired to refill the tank, valves 172 are closed and pumps 162 are energized to pump the pickling liquid from reservoir 156 through heat exchangers 160 and into tank 144, whereby the tank is quickly filled with the pickling liquid at the desired temperature.

Figure 5A:
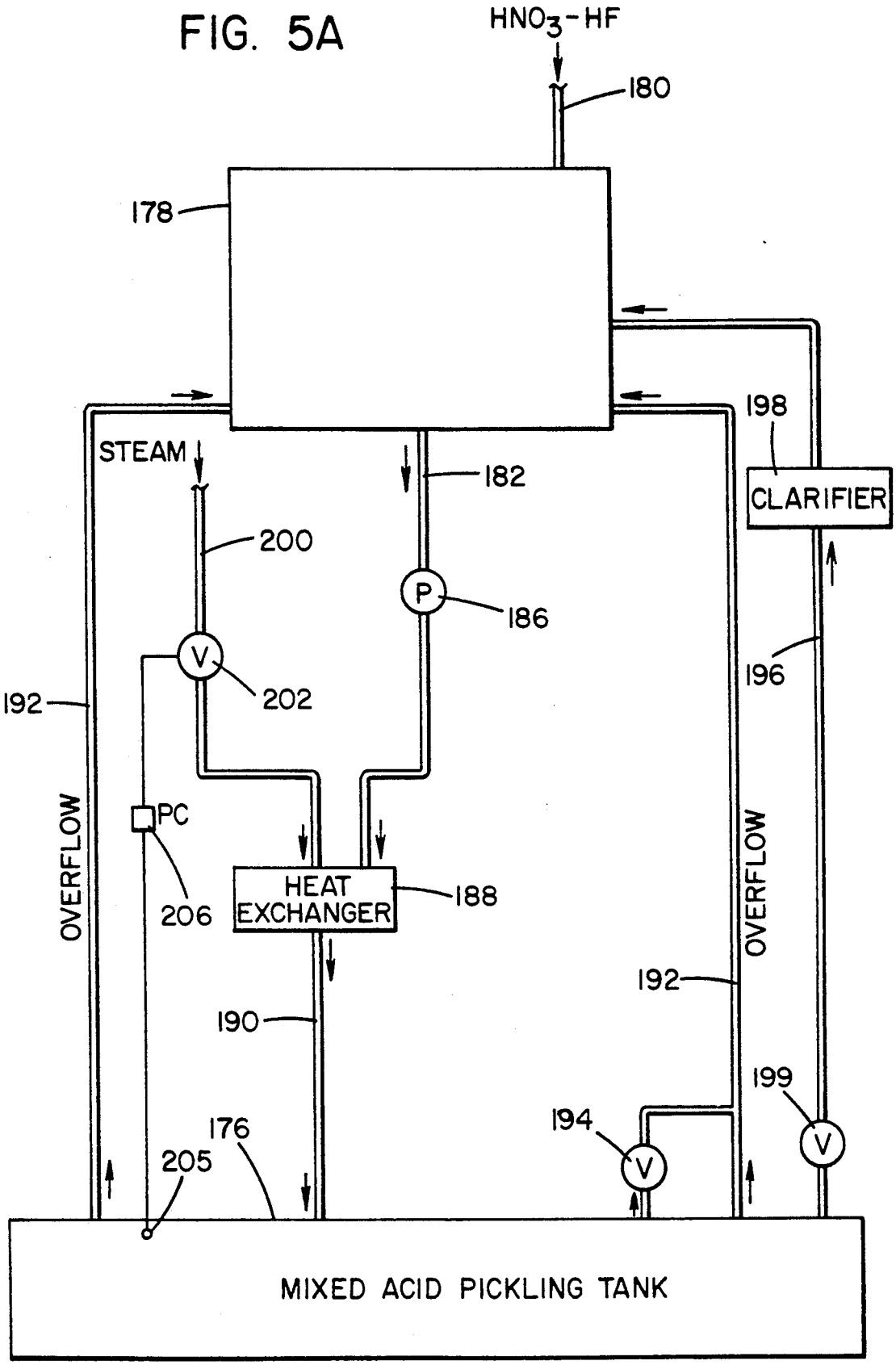
FIG. 5A is a schematic illustration of an arrangement for recirculating and heating an acid pickling liquid relative to an acid pickling tank in accordance with the present invention.

FIG. 5A schematically illustrates in somewhat more detail a recirculating system similar to that illustrated in FIG. 5. In FIG. 5A the system is illustrated in conjunction with an acid pickling tank 176, and the pickling liquid reservoir is provided by a tank 178 which is connected to a source of mixed acid, such as nitric acid and hydrochloric acid, through inlet line 180 which provides for replenishing the pickling liquid when necessary. A flow line 182 connects tanks 178 with pump 186 connected with appropriate flow control valves 184 to facilitate varying the volume of flow of pickling liquid to tank 176. The pickling liquid flows from pump 186 and valves 184 to heat exchanger 188 through a flow line 190 and, from the heat exchangers, the pickling liquid flows to tank 176 through line 190. Overflow lines 192 control the level of liquid in tank 176 and serve to return the liquid by gravity to a corresponding one of the tanks 178. One or both of the overflow return lines can be provided with a flow control valve, such as that indicated by the numeral 194 in connection with one of the lines 192 in FIG. 5A, to control the return flow to the corresponding tank. A line 196 is provided between tank 176 and reservoir tanks 178 to provide for the selective return flow of pickling liquid to the reservoir through a clarifier 198 when it is desired to filter and thus clarify the pickling liquid. Selectivity with regard to the flow through clarifier 198 is provided by a shutoff valve 199.

In the arrangement shown in FIG. 5A, heat exchanger 188 is connected to a source of steam through a common input line 200 and control valve 202 for heating the pickling liquid as it passes through the heat exchanger. The flow of steam to heat exchanger 188 is controlled in accordance with the temperature of the pickling liquid in tank 176 and, in connection therewith, a temperature sensor 205 in tank 176 is connected to a process controller 206 which controls valve 202 accordingly. In order to optimize the temperature control, temperature sensors 207 in pickling tank 176 and a sensor in reservoir tank 178 can be connected to process controller 206 for comparison therein with the temperature sensed by sensor 205.

Figure 6:
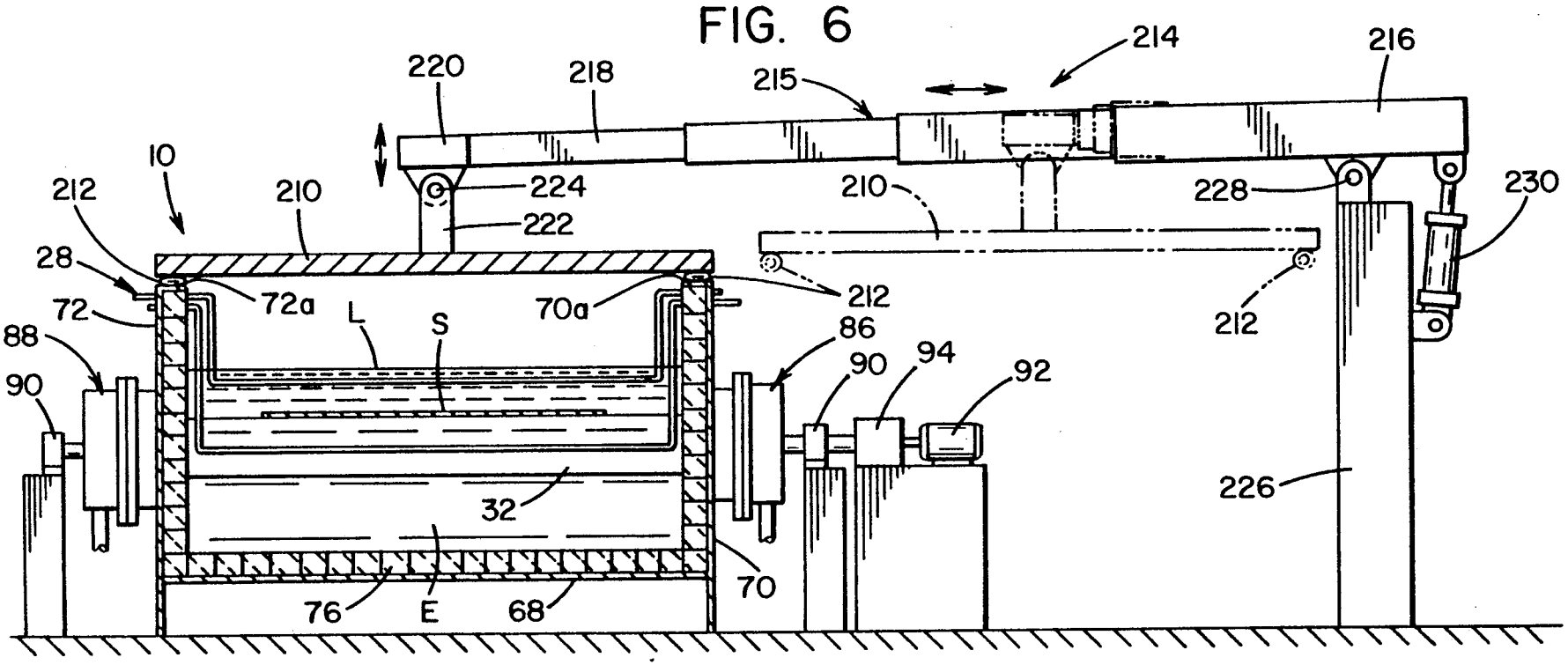
FIG. 6 is a cross-sectional elevational view of an electrolytic pickling tank having a removable cover in accordance with the present invention.
Figure 7:
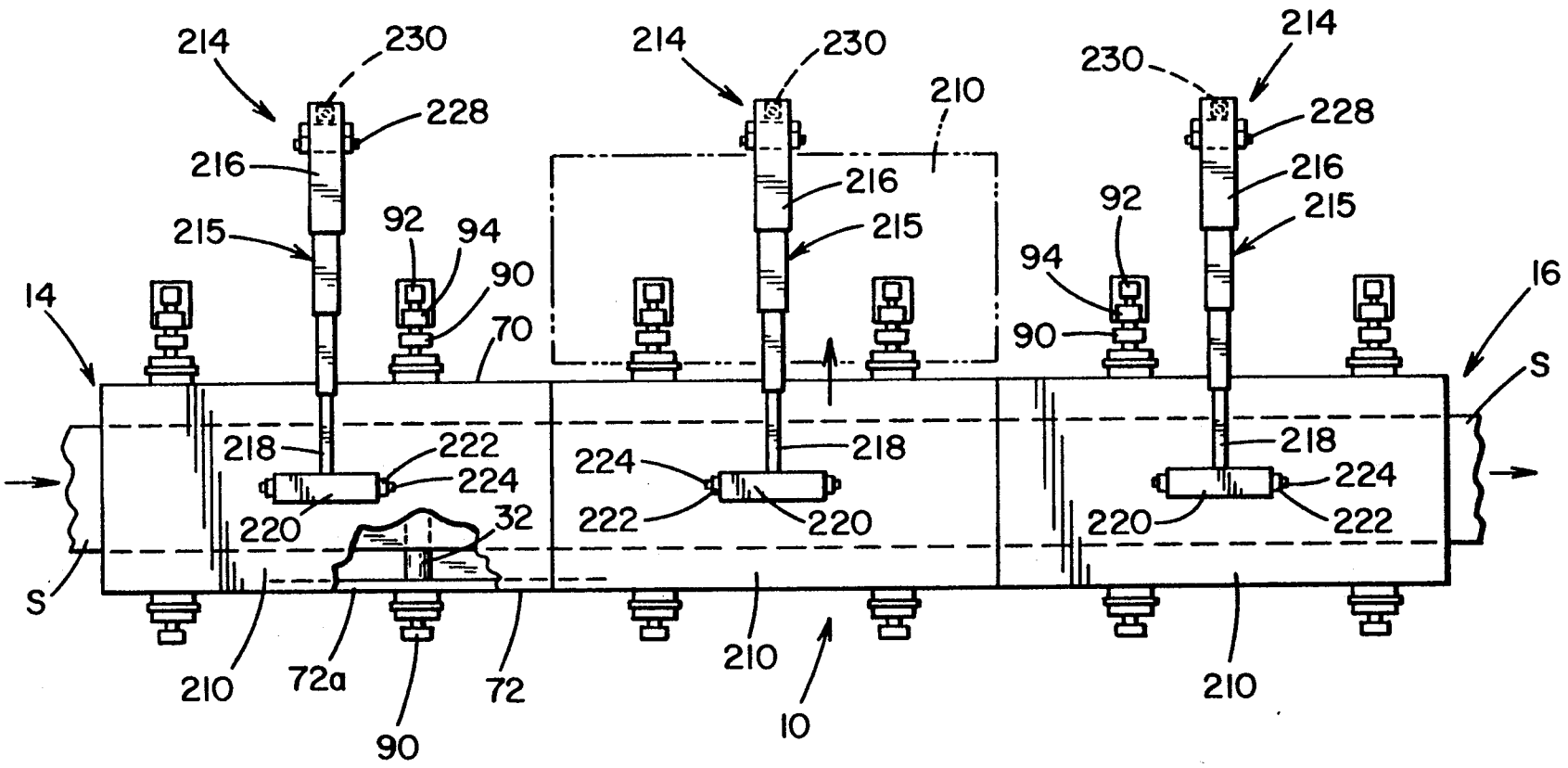
FIG. 7 is a plan view illustrating the removable cover arrangement.

In accordance with another aspect of the invention, the pickling tanks can be provided with displaceable covers such as the covers 210 illustrated in FIGS. 6 and 7 of the drawing in association with electrolytic pickling tank 10. As will be appreciated from the latter Figures, a number of covers 210 are positioned adjacent one another along the length of the tank between input and output ends 14 and 16 thereof, and each of the covers has laterally opposite sides overlying a corresponding one of the top sides 70*a* and 72*a* of side walls 70 and 72 of the tank. Further, each of the covers 210 is provided along the opposite side edges thereof with a tubular sealing member 212 of rubber or the like which is adapted to sealingly engage the corresponding one of the side wall portions 70*a* and 72*a* when cover 210 is in covering relationship with tank 10 as shown by the solid line position of the cover in FIG. 6. Each of the covers is adapted to be displaced from the covering position to an uncovering position relative to tank 10 as shown by the broken line position of the cover in FIG. 6 and, in the embodiment illustrated, such displacement of the cover is achieved through a corresponding operating mechanism 214. Operating mechanism 214 is comprised of an arm 215 defined by a plurality of telescoping sections including an outer section 216 supported laterally outwardly of tank 10 and an inner section 218 provided with a mounting bracket 220 to which cover 210 is pivotally secured by legs 222 and pivot pin 224. Outer section 216 of arm 215 is pivotally mounted on a support post 226 by means of a pivot pin 228, and a hydraulic piston and cylinder mechanism 230 is connected between section 216 and post 226 for pivoting arm 215 in opposite directions about pivot pin 228. It will be appreciated that hydraulic mechanism 230 is connected to a suitable source of hydraulic fluid, not illustrated, and that the telescoping sections of arm 215 are adapted to be displaced between the extended and retracted positions thereof relative to tank 10 such as by a hydraulic drive arrangement, not illustrated. In order to uncover tank 10, hydraulic piston and cylinder mechanism 230 is actuated to pivot arm 215 clockwise about pivot pin 228 to elevate cover 210 from the tank, and the operating mechanism is then actuated to retract the telescoping sections of arm 215 to move cover 210 laterally outwardly of tank 10 to the broken line position shown in FIGS. 6 and 7. It will be appreciated that recovering of the tank is achieved by reversing the foregoing procedure. Any number of covers can be provided for the tank and, generally, the number of covers will depend on the length of the tank. The mechanism moves the covers 210 over the top of a section of the tank and then lowers the cover so the weight of the covers compresses tubular seals 212. Such action moves the cover over each tank section into a rest position sealing a given section of the tank. In the past the cover was the length of the tank and was often left open because of the difficulties in operating the cover of the tank. Even though a hydraulic operating mechanism is preferred the movement of the covers can be accomplished by various mechanisms. It is possible to use a manually manipulated crank or winch.

Figure 8:
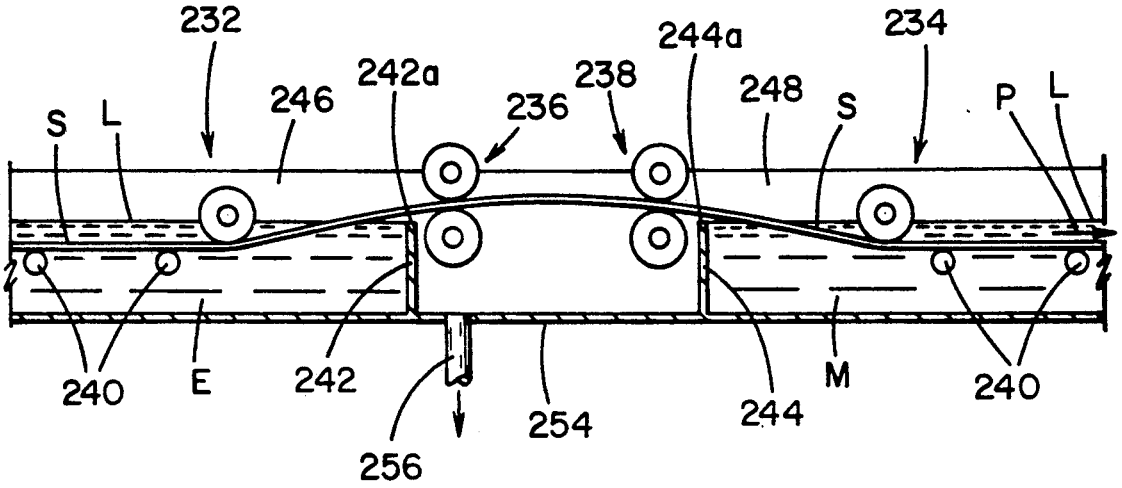
FIG. 8 is a schematic sectional elevational view illustrating an arrangement for maintaining a predetermined liquid level in a pickling tank according to the present invention; and, FIG. 9 is a plan view illustrating another arrangement for maintaining a predetermined liquid level in a pickling tank according to the present invention.

FIG. 8 schematically illustrates a modification of the transition area 43 between adjacent pickling tanks 10 and 12 in FIGS. 1 and 2 to provide an inexpensive version of the invention. In FIG. 8, the transition area is shown between adjacent pickling tanks 232 and 234 and between the squeegee roll assembly 236 at the output end of tank 232 and the squeegee roll assembly 238 at the input end of tank 234. In this embodiment, the roll assemblies are vertically positioned to elevate metal sheet S in the transition area so that the sheet is above the top surface L of the pickling liquid in the two tanks. As will be appreciated from the description of the pickling tanks in FIGS. 1–4, metal sheet S is supported by underlying support rolls 240 for movement through tanks 232 and 234 between the input and output ends thereof along a flat path P and immersed in the pickling liquid. The liquid level L in each of the tanks 232 and 234 is maintained by providing for the end walls 242 and 244 adjacent roll assemblies 236 and 238, respectively, to have the corresponding top edge 242*a* and 244*a* spaced below the top edge of the corresponding side walls 246 and 248 of the tanks. Preferably, tank 232 includes a wall 250 inwardly of squeegee roll assembly 236 and tank 234 includes a wall 252 inwardly of squeegee roll assembly 238. Each of the walls 250 and 252 extends between the side walls of the corresponding tank and cooperates with the end wall of the corresponding tank to prevent liquid overflow. Pickling liquid pulled over the top of edge 242*a* and dragged into the sump area 254 is returned to a reservoir therefor through a drain line 256. By elevating roll assemblies 236 and 238 as shown in FIG. 8, the strip can be transported from tank 232 to tank 234 without complicated mechanisms. This concept could not be used easily with a continuous strip of material. In this simplified version, the sealing arrangement of FIGS. 3, 4 and 4A is used. Strip S remains essentially in a straight, horizontal path P and is pulled by a bridle and from a bridle.

Figure 9:
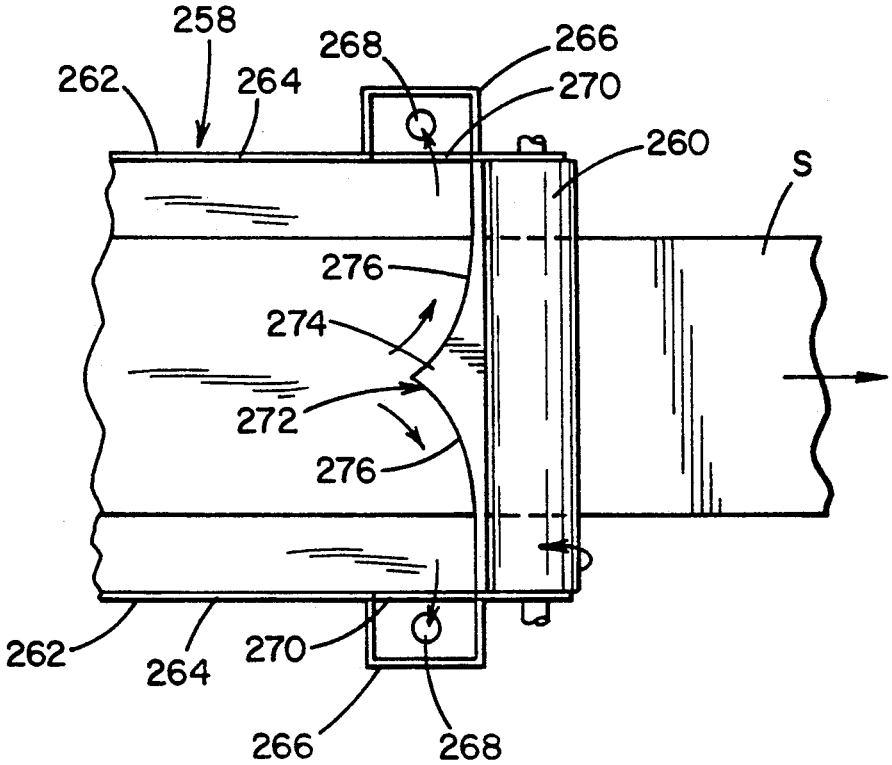

As mentioned hereinabove in connection with the description of FIGS. 1 and 2 of the drawing, and as described above in connection with the embodiment of FIG. 8, the opposite ends of a pickling tank in accordance with the present invention are provided with weir-like arrangements for maintaining the pickling liquid at a predetermined level in the tank. One such arrangement which can be used in connection with pickling tanks 10 and 12 shown in FIGS. 1 and 2 and FIG. 8 of the drawing is somewhat schematically illustrated in FIG. 9 in connection with the output end of of a pickling tank 258. More particularly in this respect, the output end of the pickling tank is provided with a pair of dam rolls, only the upper one of which, roll 260, is visible in FIG. 9, and it will be appreciated that metal sheet S exits the output end of the tank between the dam rolls. Tank 258 has opposite side walls 262 having corresponding top edges 264, and an overflow housing 266 is associated with each of the side walls 262 adjacent roll 260 and is provided with a corresponding drain opening 268 leading from the tank to a reservoir for the pickling liquid in the tank. Each of the side walls 262 is notched longitudinally within the corresponding housing 266 to provide a horizontal upper edge 270 spaced below the corresponding upper edge 264 of the side wall and spaced above the bottom of the tank 258 a distance which corresponds to the desired level of the pickling liquid therein. Accordingly, as pickling liquid is introduced into the tank in connection with the recirculation thereof referred to hereinabove, the liquid flows across edges 270 into housing 266 and thus is returned to the recirculating system, whereby the liquid is maintained at the desired level therefor within tank 258. While not shown in the schematic representation of FIG. 9, housings 266 could be provided in conjunction with or as extensions of the housings 118 and 120 shown in FIG. 4 in connection with the seal arrangements at opposite ends of the dam rolls.

At the output end of the pickling tank, it is preferred to provide a diverter 272 within the tank adjacent the dam roll assembly to divert the pickling liquid in laterally opposite directions towards the corresponding overflow housing 266. In the embodiment shown, this is achieved by providing for diverter 272 to have a nose 274 generally centrally between side walls 262 and facing the upstream end of tank 258 and arcuate surfaces 276 diverging from nose 274 toward the downstream ends of edges 270. As sheet S moves through tank 258 from left to right in FIG. 9, the pickling liquid tends to move in the same direction and diverter 272 advantageously smoothly diverts the liquid flow laterally towards housing 266. Such diversion minimizes the splashing of the liquid over the roll in the direction of strip movement. Consequently, roll drag out is reduced.

The invention could be used for pickling and/or cleaning discrete, flat plates as they are transported by the various driven rolls along horizontal path P. The dam rolls could be used as feed rolls, especially for pickling of plates. It is possible to use an apron between adjacent driven rolls just below path P to facilitate threading of strip S or support of the unsupported front ends of plates.

While considerable emphasis has been placed on the preferred embodiments herein illustrated and described, it will be appreciated that other embodiments of the invention can be made and that changes can be made in the preferred embodiments without departing from the principles of the invention. Accordingly, it is to be distinctly understood that the foregoing descriptive matter is to be interpreted merely as illustrative of the invention and not as a limitation.

Having thus described the invention, it is claimed:

1. Apparatus for pickling metal sheet moving along a generally flat horizontal path, said apparatus comprising a shallow tank means having input and output ends and adapted to contain a liquid, guiding roll means at each said input and output ends for guiding said sheet through said tank means, said sheet being immersed slightly in said liquid in said tank means between said input and output ends; support roll means in said tank means beneath and supporting said metal sheet for movement through said tank means along a linear path between said input and output ends, means for driving said metal sheet through said tank means along said path at a given speed; and, means for driving said support roll means at a speed corresponding to said given speed.

2. Apparatus according to claim 1, wherein said tank means has opposite side wall means between said input and output ends and each said roll means and support roll means has opposite end means including shaft means extending through openings therefor in said side wall means, means outside said side wall means for rotatably supporting said shaft means, seal means on each of said opposite end means of said roll means and support roll means for sealingly engaging the corresponding side wall means radially outwardly of the corresponding one of said openings, said seal means includes a ring secured to said roll means and coacting with a low friction plate secured to said side wall means for forming a sealing interface between said shaft and said side wall means.

3. Apparatus according to claim 2, wherein each said seal means is an annular seal member having a body portion mounted on said end means of said corresponding roll means and having an annular lip extending from said body portion at an angle to said corresponding low friction plate on said side wall means of said tank means, said lip having an annular outer end rotatably and slidably engaging said corresponding side wall means of said tank means.

4. Apparatus according to claim 2, wherein said guiding roll means includes upper and lower rolls at each of said input and output ends of said tank means, said lower rolls, a portion of said upper rolls and said support roll means each being immersed in said liquid to form a set of dam rolls.

5. Apparatus according to claim 4, wherein each said seal means is an annular seal member having a body portion mounted on said end means of said corresponding roll means and having an annular lip extending from said body portion at an angle to said corresponding low friction plate on said side wall means of said tank means, said lip having an annular outer end rotatably and slidably engaging said corresponding side wall means of said tank means.

6. Apparatus according to claim 2, wherein said tank means includes means adjacent at least one of said input and output ends for maintaining said liquid at a predetermined level in said tank means.

7. Apparatus according to claim 6, wherein said means for maintaining said liquid at a predetermined level includes diverter means in said tank means adjacent said output end for diverting liquid laterally of said path, and drain means laterally outwardly of said tank means for receiving said diverted liquid.

8. Apparatus according to claim 6, wherein said means for maintaining said liquid at a predetermined level includes weir means adjacent said input and output ends of said tank means and drain means adjacent each said weir means.

9. Apparatus according to claim 6, wherein said tank means includes opposite side wall means between said input and output ends, said means for maintaining said liquid at a predetermined level including weir means in said opposite side wall means adjacent said output end, diverter means in said tank means adjacent said output end for diverting liquid laterally of said path toward said weir means, and drain means laterally outwardly of said weir means.

10. Apparatus according to claim 1, wherein said tank means includes laterally opposite sides between said input and output ends, each said opposite side including laterally spaced inner and outer wall means, said guiding roll means and said support roll means having axes of rotation transverse to said opposite sides and end faces facing a corresponding of said inner wall means, said guiding roll means and support roll means further having shaft means extending laterally outwardly from said end faces through enlarged openings therefor in the corresponding inner and outer wall means, first seal means on each said end face sealingly engaging the corresponding inner wall means radially outwardly of the enlarged opening therethrough, and second seal means on said shaft means between said inner and outer wall means and sealingly engaging the corresponding outer wall means radially outwardly of the enlarged opening therethrough.

11. Apparatus according to claim 10, wherein each said first and second seal means includes an annular body portion for mounting said seal means on the corresponding one of said end face and shaft means, and an annular sealing lip extending at an angle from said body portion and having an outer edge engaging the corresponding one of said inner and outer wall means.

12. Apparatus as defined in claim 11 including a low friction plate on said inner and outer wall means on each end of said shaft means and forming the engaging surface of said seal means.

13. Apparatus as defined in claim 12 wherein said plates are formed from polyethylene terephthalate.

14. Apparatus as defined in claim 12 wherein said plates are formed from glass.

15. Apparatus as defined in claim 12 wherein said plates are formed of ceramic.

16. Apparatus as defined in claim 10 including a low friction plate on said inner and outer wall means on each end of said shaft means and forming the engaging surface of said seal means.

17. Apparatus according to claim 1, and removable cover means for said tank means between said input and output ends.

18. Apparatus according to claim 17, and means for displacing said cover means between a first position covering said tank means and a second position uncovering said tank means.

19. Apparatus according to claim 17, wherein said cover means includes a plurality of cover members between said input and output ends.

20. Apparatus according to claim 19, and means for displacing said cover means including means for each said cover member for lifting and lowering said cover member relative to said tank means.

21. Apparatus according to claim 20, wherein said means for displacing said cover means includes extendable and retractable arm means pivotally supported for lifting and lowering said cover means relative to said tank means, means to pivot said arm means, and means to extend and retract said arm means.

22. Apparatus for treating metal sheet with a cleaning chemical liquid, said apparatus comprising tank means having input and output ends and adapted to contain liquid, guide roll means at each said input and output ends for guiding metal sheet through said tank means in a generally horizontal path, said metal sheet being immersed in said liquid in said tank means between said input and output ends, support roll means in said tank means beneath and supporting said metal sheet for movement through said tank means along said path between said input and output ends, means to drive said guide roll means to feed said metal sheet through said tank means along said path at a given speed, means to drive said support roll means at a speed corresponding to said given speed, said tank means having opposite side wall means between said input and output ends, each said guide roll means and support roll means having opposite end means in the direction between said side wall means, seal means on each of said opposite end means for sealingly engaging the corresponding one of said side wall means, means adjacent at least one of said input and output ends of said tank means for maintaining said liquid at a predetermined level in said tank means, and recirculating means including heat exchanger means for recirculating and maintaining liquid at a predetermined temperature in said tank means.

23. Apparatus as defined in claim 22 wherein said seal means includes two axially spaced low friction plates with openings surrounding said opposite end means, a separate seal ring, with an annular outwardly extending lip, carried by said opposite end means and engageable with one of said plates with said annular lip rotating against one of said low friction plates.

24. Apparatus as defined in claim 22 wherein said seal means includes two axially spaced low friction plates with openings surrounding said opposite end means, a separate seal ring, with an annular outwardly extending lip, carried by said opposite end means and engageable with one of said plates with said annular lip rotating against one of said low friction plates.

25. apparatus according to claim 22, wherein each said opposite side wall means includes laterally spaced inner and outer wall means, said guide roll means and said support roll means having axes of rotation transverse to said opposite side wall means and end faces facing a corresponding one of said inner wall means, said guide roll means and support roll means further having shaft means extending laterally outwardly from said end faces through enlarged openings therefor in the corresponding inner and outer wall means, first seal means on each said end face for sealingly engaging the corresponding inner wall means radially outwardly of the enlarged opening therethrough, second seal means on said shaft means between said inner and outer wall means and for sealingly engaging the corresponding outer wall means radially outwardly of the enlarged opening therethrough and a low friction plate defining said enlarged openings and engageable with each of said first and second seal means.

26. Apparatus according to claim 25, wherein each said first and second seal means includes an annular body portion for mounting said seal means on the corresponding one of said end face and shaft means, and an annular sealing lip extending at an angle from said body portion and having an outer edge engaging the corresponding one of said low friction plates.

27. Apparatus according to claim 22, wherein said guide roll means and support roll means having shaft means extending laterally outwardly from said opposite end means thereof through openings therefor in said opposite side wall means of said tank means, means outside said opposite side wall means rotatably supporting said shaft means, and drive means coupled to the shaft means of each said feed roll means and support roll means to rotate said roll means about said axes of rotation.

28. Apparatus according to claim 27, wherein each said opposite side wall means includes laterally spaced inner and outer wall means, said shaft means extending through enlarged openings therefor in the corresponding inner and outer side wall means, first seal means on each said opposite end means for sealingly engaging the corresponding inner wall means radially outwardly of the enlarged opening therethrough, and second seal means on said shaft means between said inner and outer wall means and for sealingly engaging the corresponding outer wall means radially outwardly of the enlarged opening therethrough.

29. Apparatus according to claim 28, wherein each said first and second seal means includes an annular body portion for mounting said seal means on the corresponding one of said end face and shaft means and an annular sealing lip extending at an angle from said body portion and having an outer edge engaging the corresponding one of said inner and outer side wall means.

30. Apparatus according to claim 27, wherein each said first and second seal means includes an annular body portion for mounting said seal means on the corresponding one of said end face and shaft means and an annular sealing lip extending at an angle from said body portion and having an outer edge engaging the corresponding one of said low friction plates.

31. Apparatus according to claim 22, and removable cover means for said tank means between said input and output ends, and operating means for displacing said cover means between a first position covering said tank means and a second position uncovering said tank means.

32. Apparatus according to claim 31, wherein said cover means includes a plurality of cover members and said operating means includes separate operating means for each said cover member.

* * * * *